US010240486B2

(12) United States Patent
McGrail et al.

(10) Patent No.: US 10,240,486 B2
(45) Date of Patent: Mar. 26, 2019

(54) HARMONIC ADSORPTION RECUPERATIVE POWER SYSTEMS AND METHODS

(71) Applicants: Battelle Memorial Institute, Richland, WA (US); Rockwell Collins Inc., Cedar Rapids, IA (US); EthosGen, LLC, Wilkes-Barre, PA (US)

(72) Inventors: B. Peter McGrail, Pasco, WA (US); Radha Kishan Motkuri, Richland, WA (US); Jeromy J. Jenks, Hines, OR (US); Paul Roege, Wilkes-Barre, PA (US); William Abrams, Simpsonville, SC (US)

(73) Assignees: Battelle Memorial Institute, Richland, WA (US); Rockwell Collins Inc., Cedar Rapids, IA (US); Ethosgen, LLC, Wilkes-Barre, PA (US)

( * ) Notice: Subject to any disclaimer, the term of this patent is extended or adjusted under 35 U.S.C. 154(b) by 9 days.

(21) Appl. No.: 15/634,690

(22) Filed: Jun. 27, 2017

(65) Prior Publication Data

US 2017/0370251 A1 Dec. 28, 2017

Related U.S. Application Data

(60) Provisional application No. 62/355,292, filed on Jun. 27, 2016.

(51) Int. Cl.

| | |
|---|---|
| ***F01K 13/00*** | (2006.01) |
| ***F25B 37/00*** | (2006.01) |
| ***F01K 25/00*** | (2006.01) |

(52) U.S. Cl.

CPC ..... *F01K 13/006* (2013.01); *F01K 25/00* (2013.01); *F25B 37/00* (2013.01)

(58) Field of Classification Search

CPC ..... F01K 25/00; F01K 13/006; F25B 37/00; F25B 15/02; F25B 25/02; F25B 2315/006

See application file for complete search history.

(56) References Cited

U.S. PATENT DOCUMENTS 3,925,041 A * 12/1975 Patterson ..... B01D 53/0423 96/133
4,194,891 A * 3/1980 Earls ..... B01D 53/0473 95/130

(Continued)

OTHER PUBLICATIONS

Akkimaradi et al., "Effect of packing density and adsorption parameters on the throughput of a thermal compresser," *Carbon*, 40:2855-2859 (Jun. 19, 2002).

(Continued)

*Primary Examiner* — Mark A Laurenzi
*Assistant Examiner* — Shafiq Mian
(74) *Attorney, Agent, or Firm* — Klarquist Sparkman, LLP

(57) ABSTRACT

A new power generation thermodynamic cycle is described that eliminates need for bulk liquid condensation and vaporization steps required in conventional ORC power systems. An exemplary harmonic adsorption recuperative power cycle system offers more efficient power generation as compared with conventional ORC systems. A multibed adsorption system is used to provide thermal compression for the cycle. An adsorption compressor contains a sorbent with strong adsorption affinity for the working fluid in the pores while well outside the P-T conditions needed to condense the liquid phase, allowing the adsorption compressor to reduce operating pressure exiting the expander.

22 Claims, 14 Drawing Sheets

(56) References Cited

U.S. PATENT DOCUMENTS 4,312,640 A * 1/1982 Verrando ..... B01D 53/04 95/105
4,694,659 A * 9/1987 Shelton ..... F25B 17/08 62/106
5,823,003 A 10/1998 Rosser, Jr. et al.
6,245,127 B1 * 6/2001 Kane ..... B01D 53/0446 95/101
6,974,496 B2 12/2005 Wegeng et al.
9,097,445 B2 8/2015 Minhas et al.
9,683,776 B2 * 6/2017 Stylianou ..... C10L 3/101
2004/0107832 A1 * 6/2004 Tongue ..... B01D 53/0462 95/96
2005/0086971 A1 * 4/2005 Wells ..... F25B 15/02 62/324.2
2007/0051238 A1 * 3/2007 Jain ..... B01D 53/0462 95/96
2009/0038477 A1 * 2/2009 Abe ..... B01D 53/0415 96/154
2011/0005267 A1 * 1/2011 Lambert ..... B60H 1/32 62/476
2011/0219802 A1 * 9/2011 Minhas ..... F01K 13/00 62/238.3
2011/0232305 A1 9/2011 Minhas et al.
2013/0269519 A1 * 10/2013 Taylor ..... B01D 53/047 95/25
2014/0230401 A1 * 8/2014 Dunn ..... F02C 3/34 60/39.52
2015/0291870 A1 * 10/2015 Van Horn ..... C09K 5/047 252/69
2016/0136613 A1 * 5/2016 Tour ..... B01J 20/2808 502/416

OTHER PUBLICATIONS

Boothaisong et al., "Three-dimensional transiet mathematical model to predict the heat transfer rate of a heat pipe," *Advances in Mechanical Engineering*, 11 pages (2015), downloaded May 6, 2016.
Dutta et al., "Organic Brayton Cycles with solid sorption thermal compression for low grade heat utilization," *Applied Thermal Engineering*, 62:171-175 (Aug. 27, 2013).
Green et al., "Geothermal-the Energy Under Our Feet," National Renewable Energy Laboratory, Technical Report, NREL/TP-840-40665, 21 pages (Nov. 2006).
Motkuri et al., "Fluorocarbon adsorption in hierarchical porous frameworks," *Nature Communications*, 7 pages (Jun. 11, 2014).
Mukherjee, "Effectively Design Shell-and-Tube Heat Exchangers," *Chemical Engineering Progress*, 17 pages (Feb. 1998).
Oleksiak, et al., "Synthesis Strategies for Ultrastable Zeolite GIS Polymorphs as Sorbents for Selective Separations," *Chem. Eur. J.*, 22:16078-16088 (Sep. 2, 2016).
Quoilin et al., "Performance and design optimization of a low-cost solar organic Rankine cycle for remote power generation," *Solar Energy*, 85:955-966 (Feb. 15, 2011).
Velez, et al., "Thermodynamic analysis of R134a in an Organic Rankine Cycle for power generation from low temperature sources," *DYNA*, 81(185):153-159 (Jun. 2014).
Welch et al., "New Turbines to Enable Efficient Geothermal Power Plants," *GRC Transactions*, 33:765-772 (2009).

* cited by examiner

HARMONIC ADSORPTION RECUPERATIVE POWER SYSTEMS AND METHODS

CROSS-REFERENCE TO RELATED APPLICATION

This application claims the benefit of U.S. Provisional Patent Application No. 62/355,292, filed on Jun. 27, 2016, which is incorporated by reference herein in its entirety.

ACKNOWLEDGMENT OF GOVERNMENT SUPPORT

This invention was made with government support under grants DE-FG02-03ER46057 and DE-AC05-76RL01830 awarded by the United States Department of Energy. The government has certain rights in the invention.

FIELD

This disclosure is related to the field of thermodynamic power generation systems and methods.

BACKGROUND

There is great interest in extracting economic benefit from the vast quantity of low and mid-grade heat rejected to the environment from primary energy generation and conversion sources. In the U.S., this amounts to approximately 59 quads of wasted thermal energy. Geothermal resources at temperatures between 100 and 200° C. represent an additional very large (100 GWth) and widely geographically dispersed resource. If even a fraction of the geo-pressured and co-produced resource fluids could be used to provide power, economically, it could easily quadruple the United States geothermal energy production output.

The principal reason why these thermal resources are not more fully exploited is cost. Low grade heat sources have modest exergy that can be turned into useful work. This means that standard power generation equipment, heat exchangers, expanders, pumps, etc., are significantly larger for the amount of power generated and efficiency of standard thermodynamic cycles such as the Organic Rankine Cycle (ORC) are inherently low, less than 10% typically. Moreover, conventional ORC power systems require bulk liquid condensation and vaporization to operate. These systems can fail to produce power at high ambient temperature and low driving temperature conditions because pressure drop across the expander eventually becomes too small to drive the engine and also achieve condensation of the working fluid in the condenser.

The resulting high capital and operating costs relative to the amount of revenue that can be generated from power sales is rarely very economically attractive, especially today with low costs for natural gas. Hence there is a need for new systems and methods that can dramatically bend the cost curve of power production from low grade heat sources.

SUMMARY

The technology disclosed herein includes a new power generation system that can eliminate the need for bulk liquid condensation and vaporization steps, which are required in conventional ORC power systems. Disclosed systems integrate a multi-bed adsorption-based system that provides thermal compression needed for the thermodynamic cycle. The adsorption compressor can contain a sorbent with a strong and highly temperature dependent adsorption affinity for the working fluid. Some suitable sorbents can achieve >98% of the theoretical liquid density of the working fluid in the pores of the sorbent while the working fluid remains outside the P-T conditions necessary to condense the working fluid to its liquid phase. This allows the adsorption compressor to reduce the operating pressure exiting the expander more than is thermodynamically feasible with an ORC system operating with low driving source temperatures. Energy balance calculations show that such a system can continue to produce power under higher ambient temperatures, and can also generate much more power (e.g., at least 40% more) on average.

In some embodiments, the power generation system comprises a thermal compression system comprising two or more independent adsorbers each containing a sorbent, wherein the working fluid passes in and out of the adsorbers and is adsorbed by, or desorbed from the sorbent, wherein the heat exchange fluid passes through the thermal compression system and transfers energy to and from the working fluid confined in the sorbent; and wherein the working fluid remains in vapor phase while in the thermal compression system without condensing into liquid phase. The two or more independent adsorbers can alternate between an adsorption phase and a desorption phase, for example with the two or more independent adsorbers operating out of phase with one another such that at least one adsorber is adsorbing the working fluid while at least one adsorber is desorbing the working fluid. The working fluid exiting the engine can flow into one of the adsorbers in an adsorption phase, and working fluid entering the engine can flow from one of the adsorbers in a desorption phase. In some embodiments, the thermal compression system comprises four or more independent adsorbers. In such embodiments, the four or more independent adsorbers can alternate between a pre-cooling phase, an adsorption phase, a pre-heating phase, and a desorption phase.

The foregoing and other objects, features, and advantages of the disclosed technology will become more apparent from the following detailed description, which proceeds with reference to the accompanying figures.

BRIEF DESCRIPTION OF THE DRAWINGS

FIG. 7A shows a single tube, FIG. 7B shows a cross-sectional profile of a single tube, FIG. 7C shows a group of tubes coupled together with baffles and end portions, and FIG. 7D shows the module with an outer shell positioned around the group of tubes.

DETAILED DESCRIPTION

Disclosed herein are exemplary non-condensing power generation systems and methods that include adsorption-based compression systems and provide improvements in cost and/or efficiency as compared with standard ORC systems. The disclosed systems can modify or eliminate the need for a condenser and an evaporator, and can eliminate the need for pumps that pump liquid working fluid through an ORC system, such as the Rockwell Collins system used in the analysis of the embodiments disclosed herein. The disclosed systems can produce at least 40% more power, and can produce power at higher ambient temperature conditions for lower driving temperatures. The disclosed systems solve the problems of, among others, operation at high ambient temperature and eliminating some components in a standard ORC system.

Figure 1:
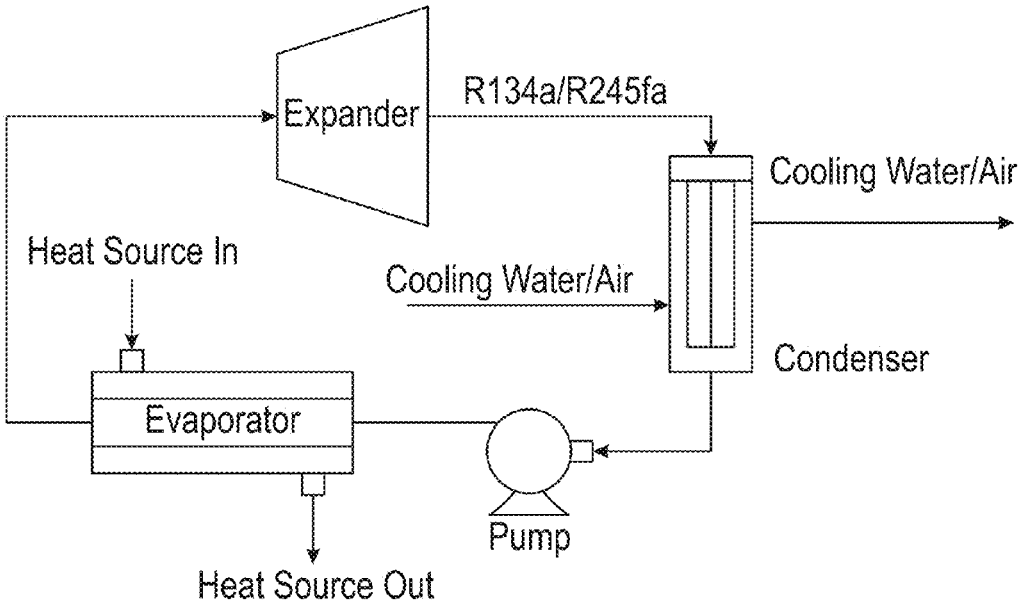
FIG. 1 (Prior Art)
FIG. 1 is a schematic of a conventional ORC power generation system.

FIG. 1 provides a schematic of a conventional ORC system configuration. The following example assumes using R134a as the working fluid in the Rockwell Collins ORC system. Typical worst case state points across the ORC expander are inlet pressure and temperature of 30 bar and 86° C. and outlet conditions of 9 bar and 37° C. Assuming an ambient temperature of the cooling water or air supplied to the condenser of 30° C., the vapor is condensed and the latent heat of condensation rejected to the environment. After exiting the condenser, a pump then raises the liquid refrigerant pressure to approximately 30 bar for input to the evaporator where heat is added and the refrigerant vaporized. Using the NIST thermochemical database for R134a and an assumed working fluid flow rate of 0.65 kg/s for this example, these state points give a maximum power output for the cycle of approximately 5.2 kW and heat dissipation to the environment of approximately 120 $kW_{th}$. As is apparent from these numbers, overall cycle efficiency is low (≈4.6%) and the evaporator/condensing units are sized according the large excess heat injection/rejection required and inefficient heat transfer in the vapor phase sections of these components. Furthermore, as ambient temperature rises above the case assumed here of 30° C., less heat can be rejected from the condenser raising the temperature and back pressure on the expander/engine, which reduces power output from the cycle. At high enough ambient temperature, condensation of R134a cannot be achieved and the ORC system cannot generate power, at least not at a suitable efficiency.

Figure 2:
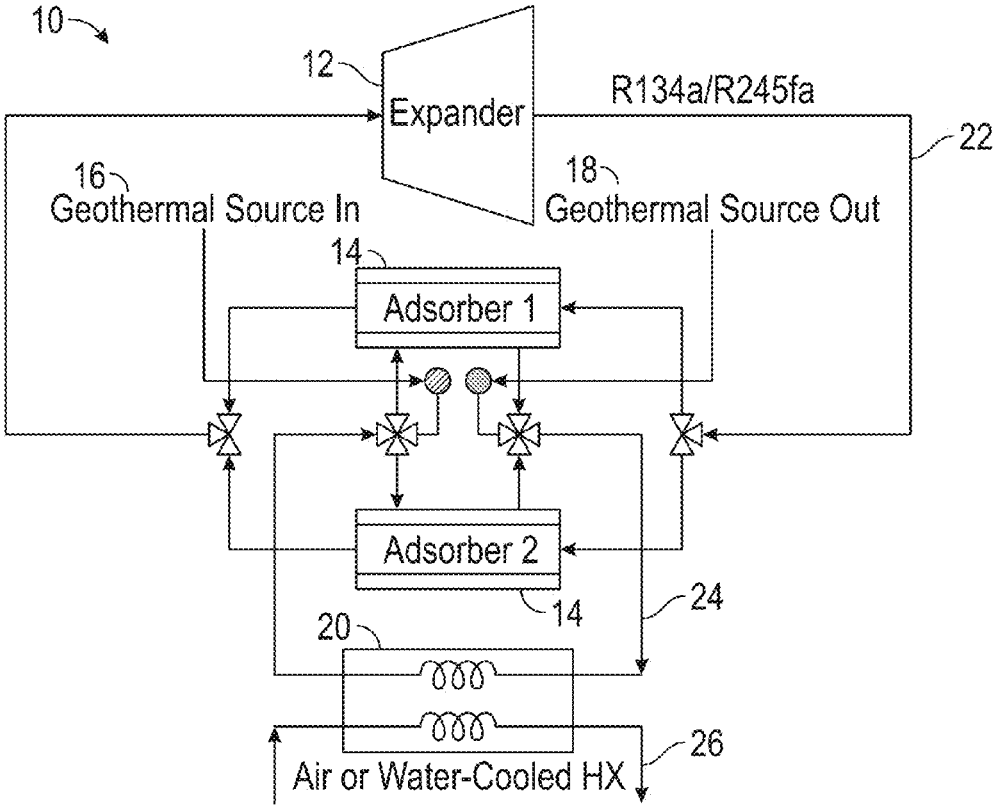
FIG. 2 is a schematic of a power generation system that comprises a multi-bed adsorption compression system.

FIG. 2 is a schematic of an exemplary harmonic adsorption recuperative power (HARP) system 10 according to the present disclosure. Such HARP systems feature a multibed heat engine architecture combined into the power generation cycle. Only two adsorption beds are shown in the example shown in FIG. 2 (adsorbers 14), while in other embodiments there can be three, four, or more adsorber beds included (see, e.g., FIG. 3. The working fluid 22 in one adsorber bed 14 is heated, which reduces the sorption affinity and thus increases fluid pressure to drive an expander 12 (which can comprise or be part of any engine, generator, a reciprocating, scroll, or turbine technology, or other mechanical power output device), which in turn delivers work to a generator, pump, or mechanically-driven device. The other adsorber bed is cooled to restore sorption affinity thus allowing a reduction in the pressure and temperature of the refrigerant 22 and creating a sink for working fluid exiting the expander 12 relative to the conventional ORC system shown in FIG. 1. Energy is added to the desorbing adsorber bed by heat exchange fluid 24 coming from a low grade heat source 16 and exiting at outlet 18. Energy is removed from the adsorbing bed by heat exchange fluid that rejects heat to the environment 26 through heat exchanger 20 or another means. In the system 10, the two adsorbers 14 can alternate between adsorption and desorption, such that one is in an adsorption mode while the other is in a desorption mode.

Figure 3:
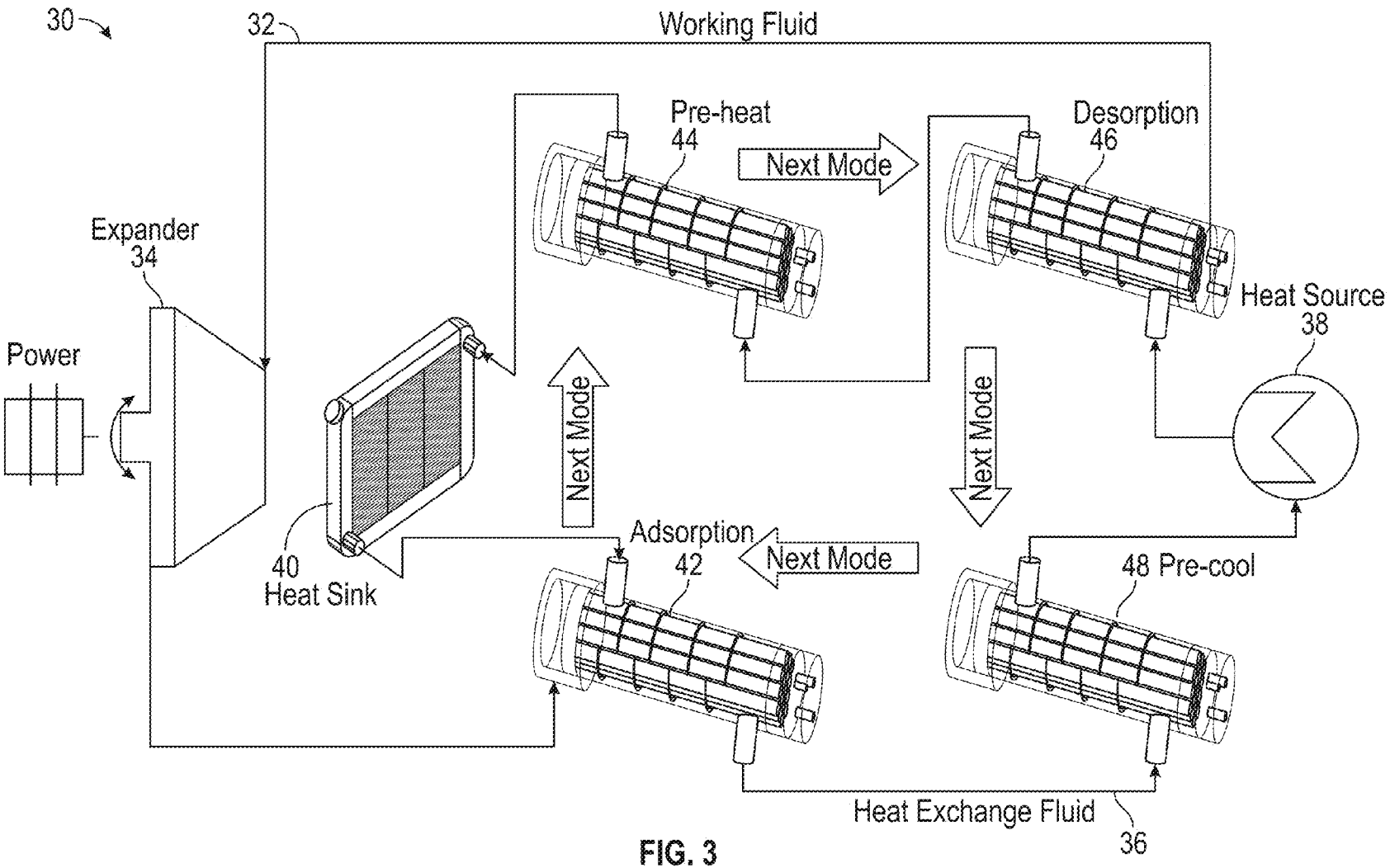
FIG. 3 is a schematic of a multi-bed adsorption power system.

FIG. 3 is a schematic of another exemplary multibed heat engine for a HARP system 30, with four adsorbers 42, 44, 46, 48. The system 30 includes a working fluid 32 that passes through an expander 34 (which can comprise, be part of, or be coupled to any type of engine/generator or other output device) and the adsorbers, and a heat exchange fluid 36 that originates from source 38, passes through one or more of the adsorbers and optionally a heat sink 40, then exits the system. The four adsorbers can cycle through different phases, including a pre-cool phase, an adsorption phase, a pre-heat phase, and a desorption phase.

Figure 4:
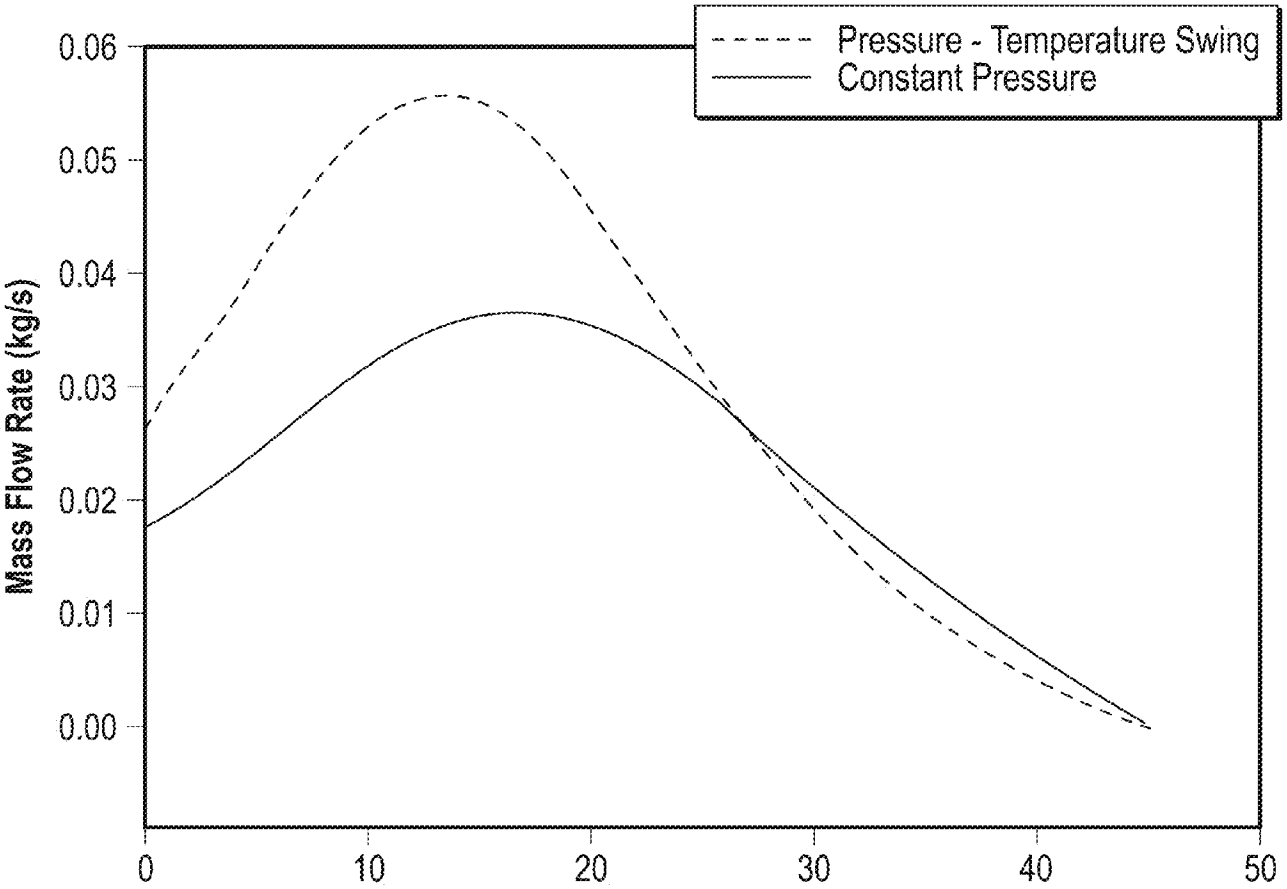
FIG. 4 is a graph illustrating the impact of varying pressure-temperature during the HARP cycle.

Because the adsorption beds in the disclosed HARP systems undergo thermal and pressure cycling, the system can benefit from minimizing the pressure/temperature swings experienced by the output engine to maintain a steady power output and can reduce mechanical fatigue on the components. Configuring the adsorbing and desorbing beds to be out of phase during the cycle helps dampen the fluctuations across the output engine. It is also advantageous to use a multi-bed configuration to optimize timing of the pressure and temperature swings of each adsorber/desorber bed in the system to generate the maximum working fluid flow rate per kg of sorbent. For example, during a desorption cycle, it is advantageous to allow the output pressure to fall to a minimum value while the bed temperature rises to its maximum temperature as this will minimize the amount of working fluid left in the sorbent bed at the end of the desorption cycle. This can be facilitated by simultaneously adsorbing to a fully regenerated bed that is at the lowest temperature and pressure in the cycle. As working fluid is adsorbed during the adsorption cycle, the pressure is allowed to increase up to a maximum value, which maximizes the working fluid loading in the sorbent. The net result is an oscillating absolute pressure at the engine inlet and outlet but a constant or approximately constant pressure differential across the engine. FIG. 4 shows the importance of this pressure-temperature cycle optimization implemented with appropriate valve timing in the HARP system. By varying the inlet and outlet pressure during the cycle versus holding a constant pressure, at increase in working fluid flow rate can be produced, which can be directly realized as additional power output.

An additional advantage is avoidance of requirement to physically condense the working fluid in the disclosed systems. However, by using a sorbent within the adsorbers with a very strong chemical affinity for the working fluid, near liquid phase densities can be achieved in the adsorption beds. By avoiding the need for condensation, the disclosed HARP systems can also impose a larger pressure drops across the engine and generate more power. The impact of this enhanced pressure drop can be quantified with a simple energy balance calculation. Power generation (P) is given by:

$$P=\eta_e \dot{m}_r(h_r^1-h_r^o) \tag{1}$$

where $\eta_e$ is the efficiency of the expander (engine), $\dot{m}_r$ is the working fluid mass flow rate, $h_r^1$ and $h_r^o$ are the outlet and inlet enthalpy across the engine, respectively. Heat flows across an adsorption bed are given by:

$$(1-\eta_h)[\dot{m}_r\Delta H_a t_c+(m_{Al}c_p^{Al}m_s c_p^s+m_v c_p^v)(T_h-T_L)]=\dot{m}_w(h_w^1-h_w^o) \tag{2}$$

where $\eta_h$ is the recuperation efficiency between beds, $\Delta H_a$ is the heat of adsorption, $t_c$ is the bed cycle time, $m_{Al}$, $m_s$, and $m_v$ are the masses of aluminum, sorbent, and refrigerant vapor in the adsorption bed, $c_p^i$ are the corresponding heat capacities, and $T_h$ and $T_L$ are the high and low temperatures of the bed during a cycle. The right hand side of Equation (2) represents the balancing heat rejection to the environment through either cooling water or an air-cooled heat exchanger. The sorbent mass required can be estimated from:

$$m_s=\frac{\dot{m}_r}{f_r}t_c \tag{3}$$

where $f_r$ is the net change in refrigerant loading across the cycle and $t_c$ is the cycle time. Using the assumed parameters in Table 1 (below), the HARP system power output is predicted to increase to 7.4 kW (or 42%) with the identical R134a flow rate of 0.65 kg/s and average output condition from the ORC engine of 30° C. and 7.5 bar for the worst case condition. Moreover, the heat dissipation required drops from 120 kW to 96 kW. This calculation assumes an unchanged state point input to the engine of 86° C. and 30 bar. However, it is possible to increase the power output further by using the adsorption modules to increase the input temperature and pressure above what is economic via a standard evaporator. This is because heat is transferred to the refrigerant through highly efficient heat exchanger modules and concentrated refrigerant (very near liquid density) adsorbed in the pore structure of the sorbent material(s) filling the adsorber modules. Heat can, therefore, be added efficiently to the working fluid until a desired pressure and temperature are reached, which can exceed the state point conditions of the conventional ORC system. Both of these factors provide opportunity for significantly higher power output from the disclosed HARP systems with the equivalent heat input and lower heat dissipation required to the environment.

Figure 5:
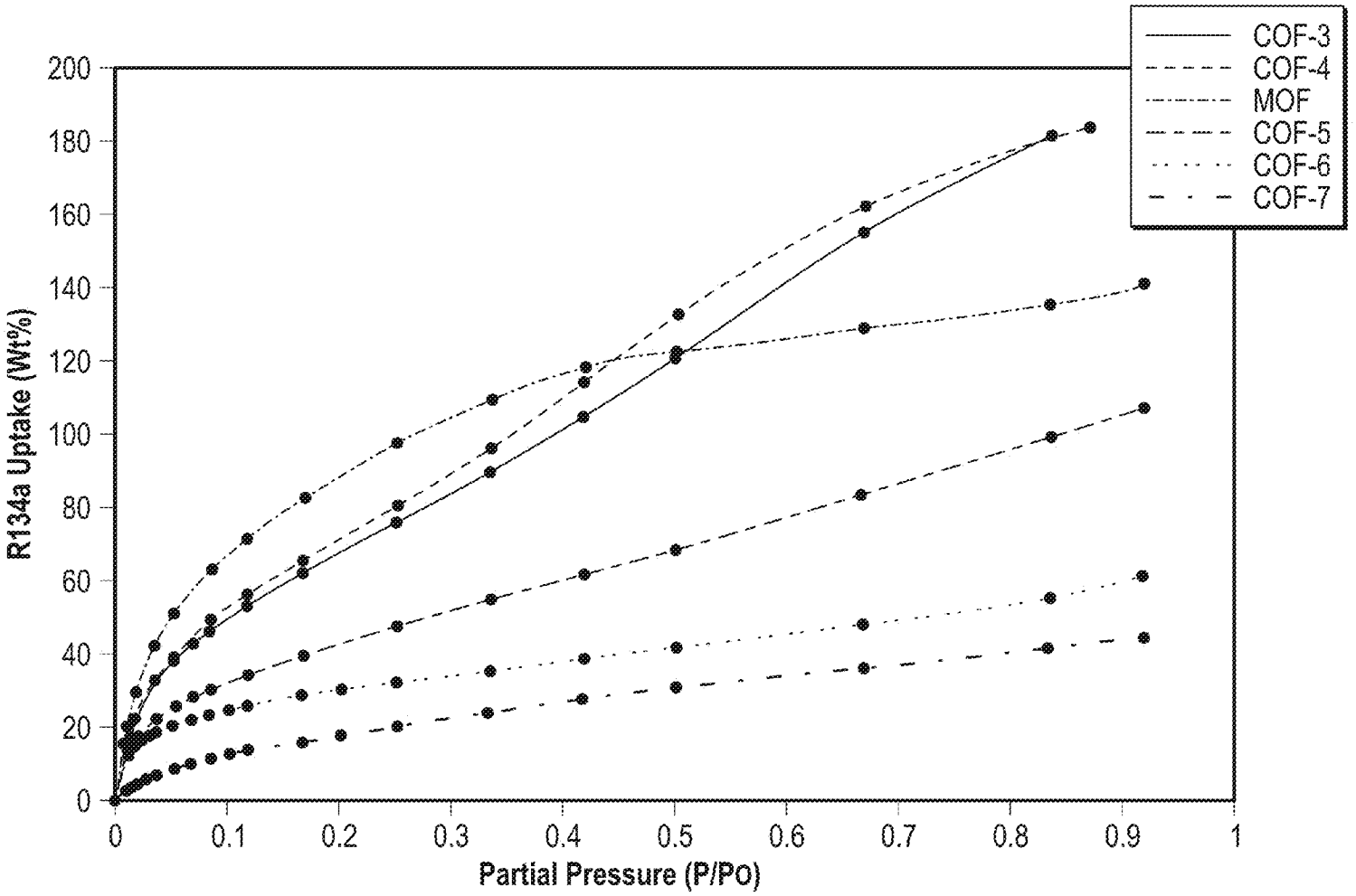
FIG. 5 is an adsorption isotherm for R134a refrigerant and several sorbents.

Achieving the power increase estimates with the disclosed HARP system can be obtained by having a high performance sorbent material that allows cycle times and refrigerant loadings consistent with the $t_c$ and $f_r$ values shown in Table 1. FIG. 5 shows adsorption isotherms for R134a with several exemplary sorbents, including several covalent organic frameworks (COFs). Among this exemplary group of sorbents, the highest capacity sorbent's (COF-4) refrigerant uptake is nearly 200 wt % as the relative saturation vapor pressure ($P/P_o$) approaches one, which is the expected condition for the output from the engine (input to the adsorption bed). In the example of a net working capacity of 130 wt % achieved in a cycle, only about 30 kg of sorbent occupying 60L of space may be needed for the HARP system.

Figure 6:
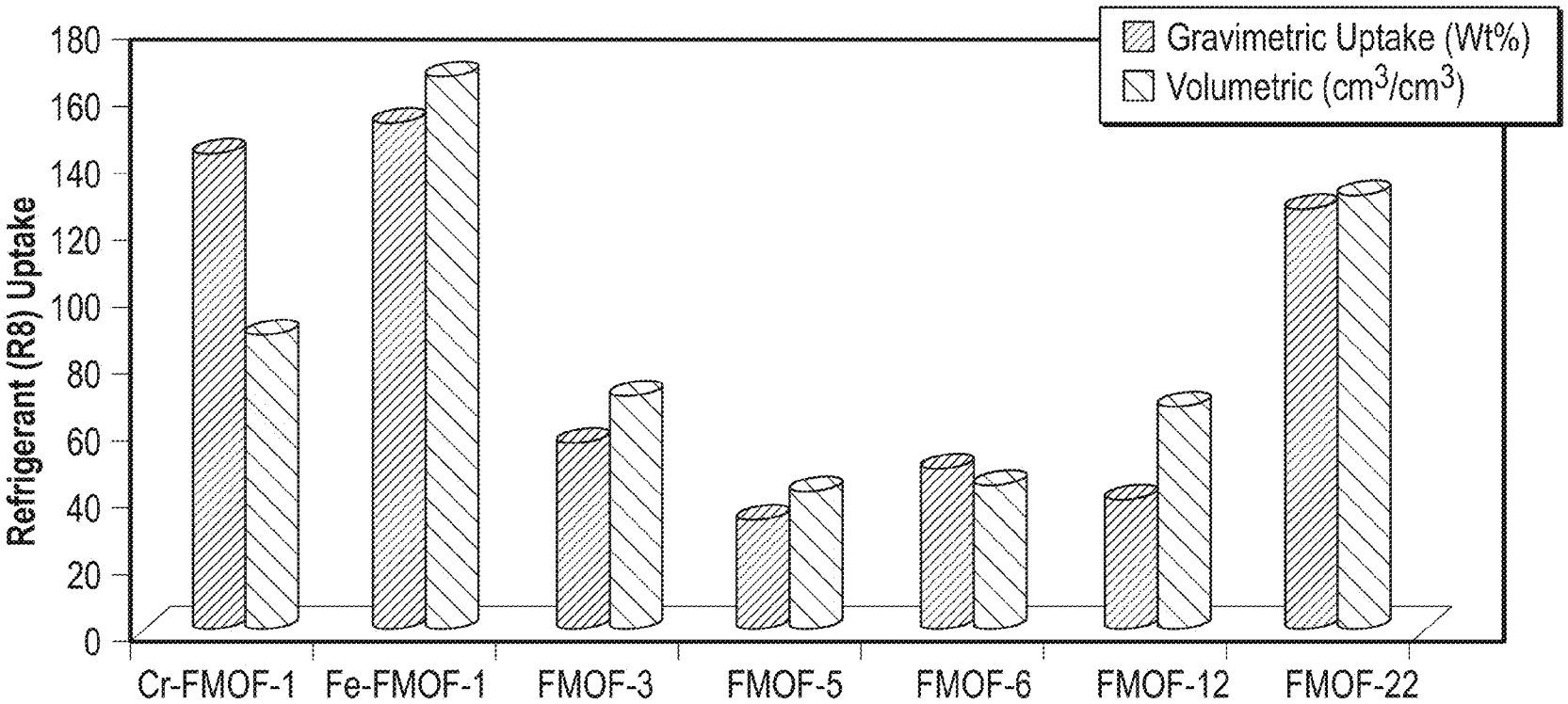
FIG. 6 is a bar graph showing a comparison of adsorption capacity for R134a with selected Metal Oxide Framework (MOF) sorbents. Volumetric adsorption capacity is an important metric for compact and efficient thermal compressor design of a HARP system.
Figure 7A:
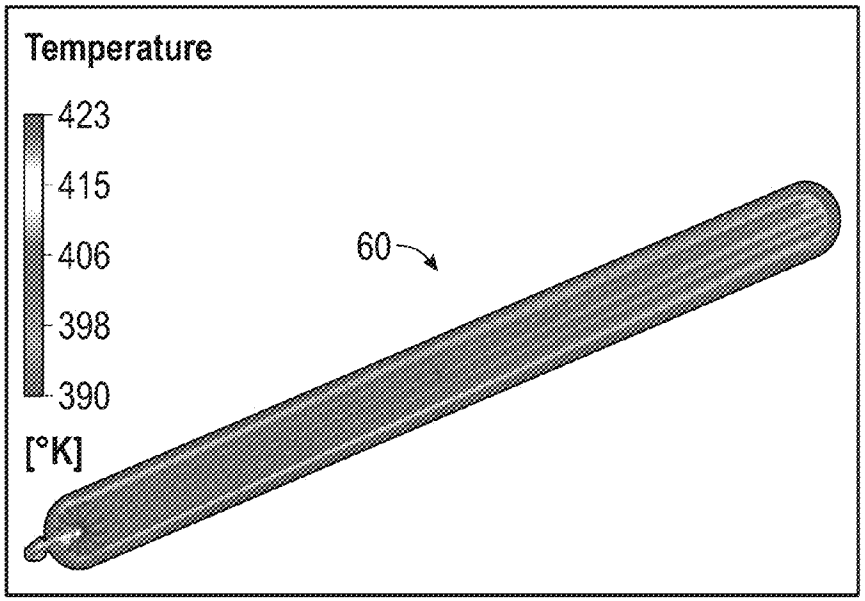
FIGS. 7A-7D illustrate an exemplary adsorption module for fluorocarbon adsorption cooling/power system having a tube-in-shell configuration.
Figure 7B:
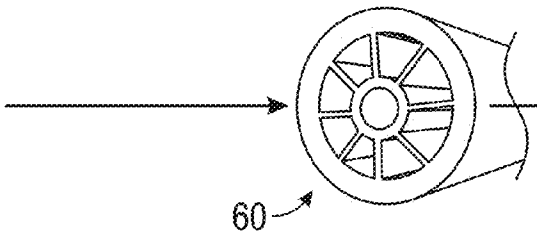
Figure 7C:
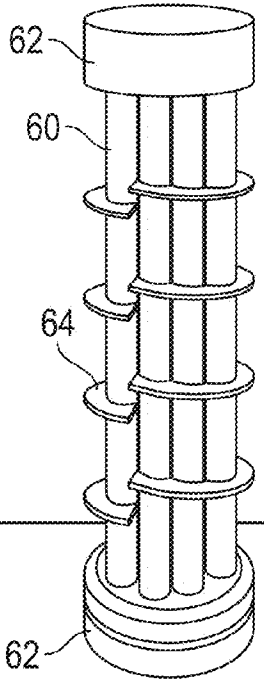
Figure 7D:
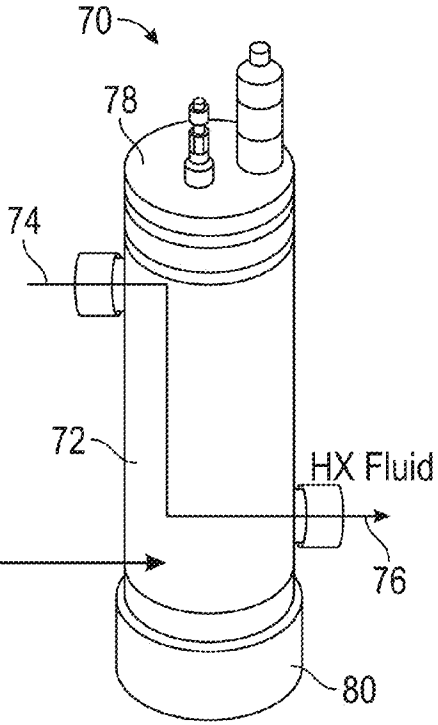

Three exemplary sorbents that are well suited for the HARP system are: 1) metal organic frameworks (MOF), 2) covalent organic frameworks (COF), and 3) hierarchical porous carbon (HPC) materials. FIG. 6 shows a summary of adsorption data for seven different MOF sorbents. Example MOF sorbents are FMOF-1 and FMOF-22 with very high sorption capacities for fluorocarbons. The chromium based FMOF-1 (Cr-MIL-101 where MIL stands for Material Institut Lavoisier) is comprised of trimeric chromium(III) octahedral clusters interconnected by 1,4-benzenedicarboxylates. It is a thermally stable highly porous 3-dimensional structure with a high BET surface area (>3000 $m^2\ g^{-1}$) and large pores (29 and 34 Å). The gravimetric sorption capacities are (~150 wt %-gravimetric) but volumetric capacities are low (<100 $cm^3/cm^3$). In order to increase volumetric capacities as well as improvise synthesis conditions, a non-toxic iron based Fe-FMOF-1 was also synthesized by replacing chromium salt with iron. This Fe-FMOF-1 has shown the highest volumetric sorption capacity (~170 $cm^3/cm^3$) towards fluorocarbons to date. Moreover, iron salt is much cheaper when compared to chromium salt and bulk synthesis conditions are much easier. Hence, Fe-FMOF-1 is a preferred sorbent in one embodiment of the HARP system. Another MOF, Fe-FMOF-22 (MIL-88B) is a hexagonal structure type comprised of iron (III) trimer octahedra that share oxygens with dicarboxylates of terepthalate. Fe-FMOF-22 shows volumetric sorption capacities up to ~140 $cm^3/cm^3$. The presence of metals and metal clusters can enhance C—F . . . $M^+$ interactions thereby increasing superfluorophilicity and sorption capacity.

Another example class of sorbents are COFs. Specific examples of COFs are COF-3 and COF-4 comprised of aromatic phenyl/biphenyl rings connected through stable covalent C—C, C—H, and C—N bonds to form highly porous and controllable structures with high surface areas. These COFs showed the highest gravimetric sorption capacities for fluorocarbons (up to ~200 wt %) but their low packing densities gives only medium volumetric capacities.

The aromatic character of the sorbent framework can be more favorable towards fluorocarbon adsorption via C—F . . . π interactions. Consequently, some preferable sorbents can comprise monomer building units with more conjugated/aromatic character. The monomer unit can provide suitable reactive groups such as OH, CN, CHO, $NH_2$ that can be selected/tuned according to the chosen polymerization reaction and the required synthesis conditions. The degree of polymerization significantly depends upon the reaction conditions, choice of solvent, choice of catalyst and amounts, and ratios between the monomer and catalyst. The ratio can greatly influence the formation of the porous framework with different pore volume, surface area, and pore-size distribution. Consequently, reaction conditions can be optimized to achieve COFs that possess similar sorption characteristics compared to COF3/COF4 materials illustrated in FIG. 5. To improve sorbent performance further, the COF surface can be functionalized with superfluorophilic moieties or decorated with alkali or transition metal ions/clusters. The metal clusters can increase the overall packing density of the material and the transition metal doping enhances C—F . . . $M^+$ interactions in the sorbent pores thereby increasing superfluorophilicity and sorption capacity.

Another sorbent class is HPC materials where textural properties and porosities can be tuned into microporous (<20 Å), mesoporous (20-500 Å) and macroporous (>500 Å) respectively. One example HPC is a commercially available activated carbon (e.g., KBB or Ketjenblack manufactured by AkzoNobel) that has both macropores as well as mesopores with a surface areas up to 1300 $m^2/g$. These HPCs are thermally stable and can be tuned to get more ordered (graphitic) carbon. KBB shows moderate to high sorption capacities both volumetrically and gravimetrically. These sorbent examples are not meant to be limiting in any way. Any sorbent material with sufficiently high adsorption capacity and adsorption kinetics can be used in embodiments of a HARP system.

TABLE 1

Exemplary HARP System Heat Balance Parameters

| Parameter | Value | Units |
|---|---|---|
| $\eta_e$ | 0.9 | |
| $T_h$ | 140 | ° C. |
| $T_L$ | 30 | ° C. |
| $h_r^o$ | 427 | kJ/kg |
| $h_r^1$ | 415 | kJ/kg |
| $\dot{m}_r$ | 0.65 | kg/s |
| tc | 60 | s |
| fr | 130% | wt % |
| $m_s$ | 30.1 | kg |
| $m_v$ | 0.96 | kg |
| $\Delta H_a$ | 350 | kJ/kg |
| $m_{Al}$ | 24.1 | kg |
| $c_p^v$ | 1.1 | kJ/kg · K |
| $c_p^s$ | 0.9 | kJ/kg · K |
| $c_p^{Al}$ | 0.9 | kJ/kg · K |
| $\eta_h$ | 0.7 | |

A thermal compressor driven by heat is created by the adsorbers of the HARP system and provides the motive force to transport the working fluid through the expansion engine. In various embodiments, the internal structures of thermal compressors created by the adsorption systems can take on different geometrical dimensions. Some exemplary embodiments are illustrated herein. Power generation applications based on the disclosed HARP systems can withstand high pressures and a very large number of thermal cycles without failure due to the thermal compressor architecture. Embodiments can be manufactured using various different techniques, including casting, brazing, extruding and additive manufacturing (3D printing) of parts. A combination of all or some of these methods can also be used.

The thermal compressor/adsorption beds can take various different structural configurations, such as tube-in-shell configurations, microchannel structures, plate-type systems, etc. FIGS. 7A-7D illustrate an exemplary tube-in-shell thermal compressor system 70 comprising several adsorber tubes 60 contained in an outer shell 72. Each tube 60 can be 3D-printed using aluminum, for example. The tubes 60 can then be fitted with baffles 64 and enclosed in a stainless steel shell 72, for example. Each tube 60 includes inner tube is a porous structure that allows refrigerant/HX fluid to pass into the system at inlet 74 and through the sorbent contained in each tube, and out through outlet 76. Internal fins within the tubes 60 (see FIGS. 7B and 11, for example) can enhance the heat transfer from the heat exchange fluid that flows between the exterior of the tubes 60 and the outer shell 72. This type of tube-in-shell thermal compressor has several advantages including ease of manufacturing and assembling. The 12-tube embodiment shown is just one exemplary configuration.

In such thermal compressors, volumetric refrigerant loading and cycle time can be significant. The cycle time can be directly proportional to the size of the thermal compressor. Additionally, refrigerant loading kinetics for a given sorbent can play a major role in that time.

Figure 8:
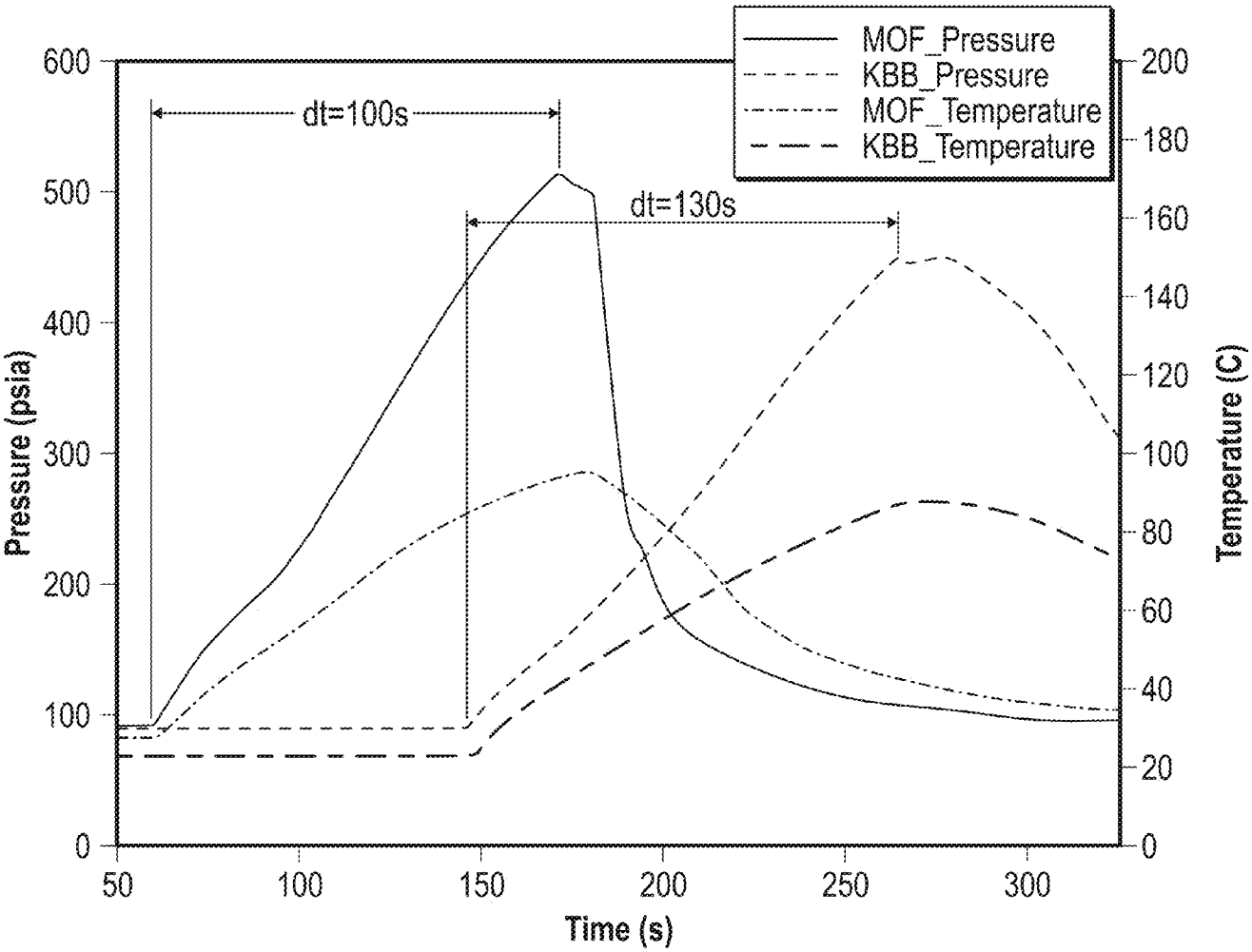
FIG. 8 is a graph illustrating pressure and temperature swing data for MOF and activated carbon (KBB) cycles with R134a in a finned copper tube.

FIG. 8 shows the pressure and temperature swing results with two different exemplary sorbents packed into a single copper tube. FIG. 8 shows results for KBB, which is just one exemplary type of activated carbon that is a commercially available, in comparison with the MOF sorbent. Other forms of activated carbon or similar materials can alternatively be used. The data from FIG. 8 shows that the MOF generates 500 psia (34 bar) 30% faster than the KBB. In addition, the sorbent loads over 30% more refrigerant per unit volume than KBB. Because compression speed and capacity are additive effects, selecting the MOF sorbent would result in a 60% smaller thermal compressor delivering the same power output.

In some embodiments, the thermal compression system can achieve a compression ratio of at least 30:1, such as 30 bar to about 1 bar for example. In some embodiments, the compression ratio can be about 15 bar to about 5 bar, for example. The cycle times can be about 90 seconds to about 100 seconds, for example.

Figure 9:
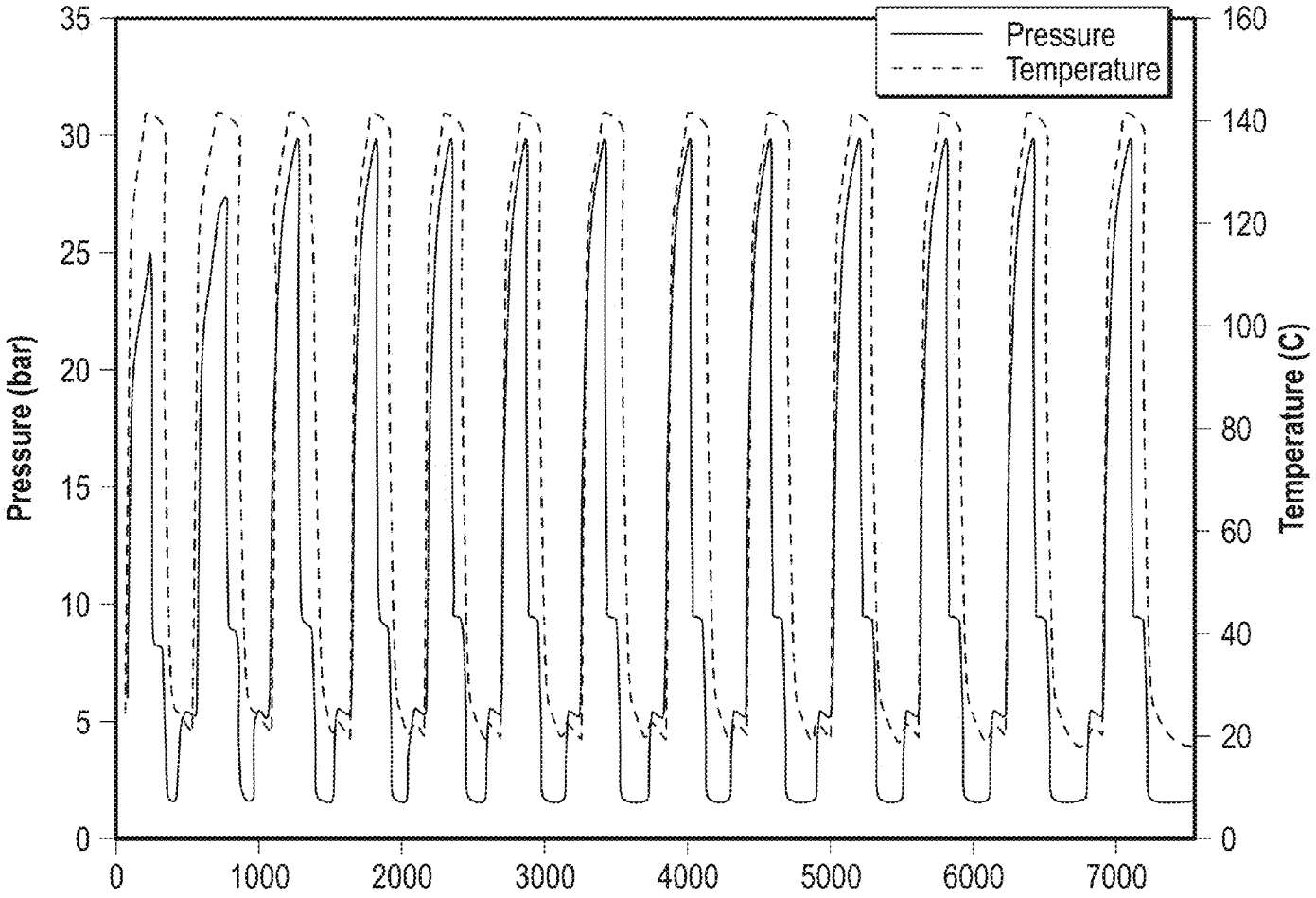
FIG. 9 is a graph illustrating pressure and temperature swing data for several thermal cycles of KBB/R134a in a shell/tube configuration.

FIG. 9 shows several automated cycles completed using KBB and R134a loaded into the shell-tube embodiment shown in FIGS. 7A-7D. The cycle time was fixed at 90 s to achieve a compression ratio of 30:1. Significant to generating sufficient work from the fluid through the expander is a high inlet enthalpy and low discharge enthalpy. These data show that once the cyclic steady state is reached (e.g., when the amount of working fluid going into the sorbent is about the same as the amount of working fluid coming out of the sorbent), the R134a pressure reaches 30 bar in less than 100 s and maintains a temperature of 140° C. during desorption. During adsorption the pressure drops to 1 bar and maintains a temperature of 20° C. The mass loading fraction during adsorption and desorption was found to be just over 1.3 g/g as determined from mass flow data. In addition, the cycle time can be reduced by at least 30% using the MOF (instead of KBB) while delivering at least 30% more working fluid flow. R134a is just one exemplary refrigerant/working fluid that can be used in the disclosed systems, and other examples include a new class of low global warming potential refrigerants like R1234yf and R1233ze. Because adsorption processes involve Van der Waals bonds, the refrigerant does not degrade over time, even after hundreds or thousands of cycles.

In one example, a 40 kW nominal standard ORC system can be upgraded with a HARP thermal compressor, such as using the MOF sorbent. Such an upgraded system can produce a power increase output and can provide more cost efficient power compared to normal ORC systems, especially with a relatively low temperature heat source.

The disclosed systems can be used with medium and low-temperature geothermal reservoirs, including geo-pressured and produced water from oil & gas operations, and other geo-pressured resources, such as are present in several areas of the United States, ranging from California and the Dakotas to Texas, Louisiana and Alabama. Hot brine (90 to 200° C.) often saturated with methane is recovered from wells at depths of 3 to 6 km. Co-produced resources consists of hot water and hydrocarbons produced concurrently during oil and gas extraction. Produced water can be difficult to handle, incurs pumping costs, and has to be reinjected at an additional cost for permitting and injection wells. For every barrel of oil produced, nearly 100 barrels of hot water are co-produced. In Texas alone, over 12 billion barrels of waste water are produced as a byproduct of oil and gas extraction. If even a small fraction of the geo-pressured and co-produced resource fluids can be used to provide power using the disclosed systems, economically, it could easily quadruple the nation's geothermal energy production output. Additional exemplary applications for the disclosed systems can include low temperature geothermal resources, waste heat sources such as heat delivered from combination diesel engine/electric generator systems (i.e., gensets), solar thermal sources, on maritime vessels, military bases, and other remote locations such as in Alaska, Arctic and Antarctic locations. Economic benefit can vary significantly based on existing electrical power rates.

Figure 10:
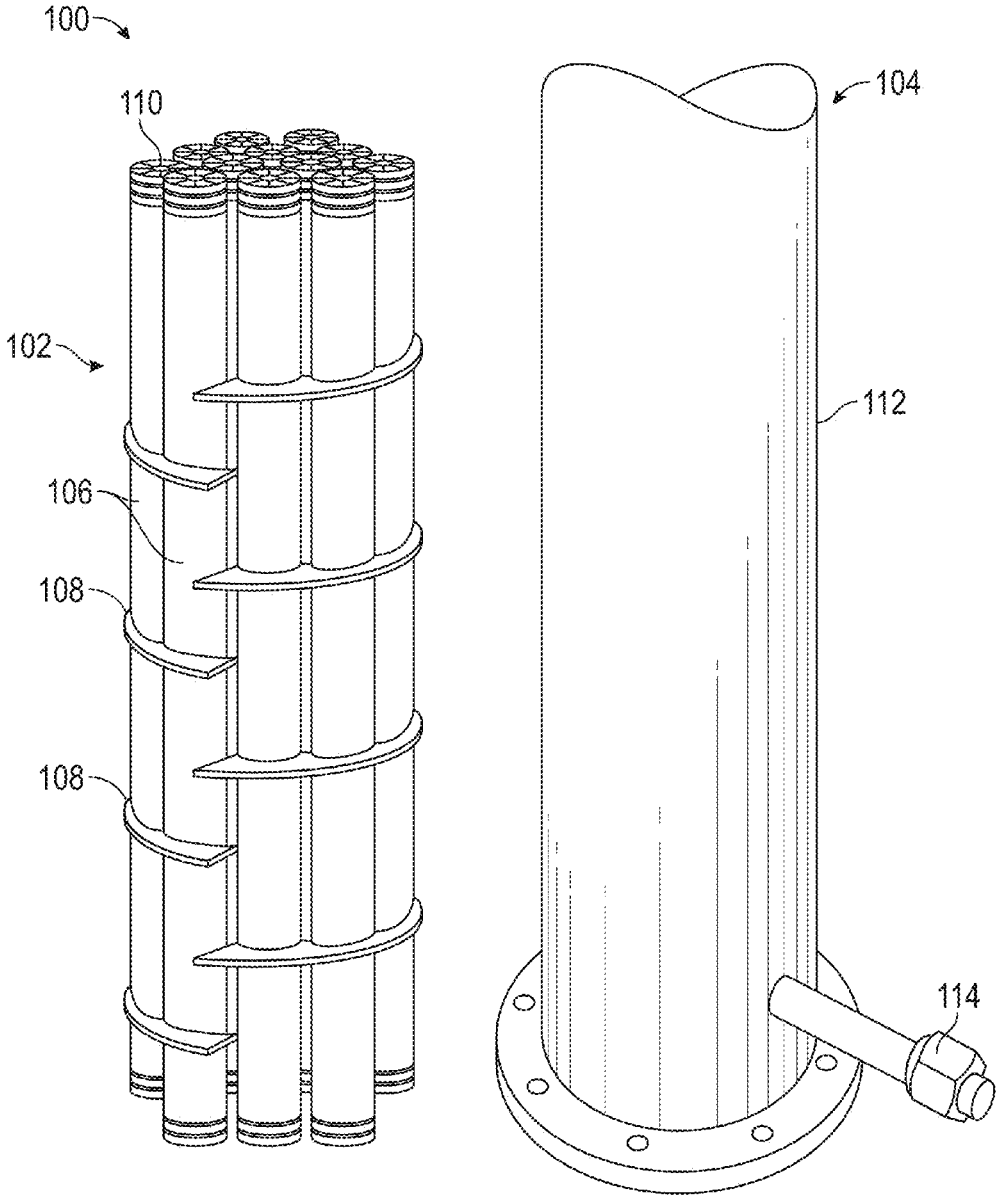
FIG. 10 shows an exemplary tube-in-shell adsorption cooling system with the outer shell separated from the inner group of tubes.
Figure 11:
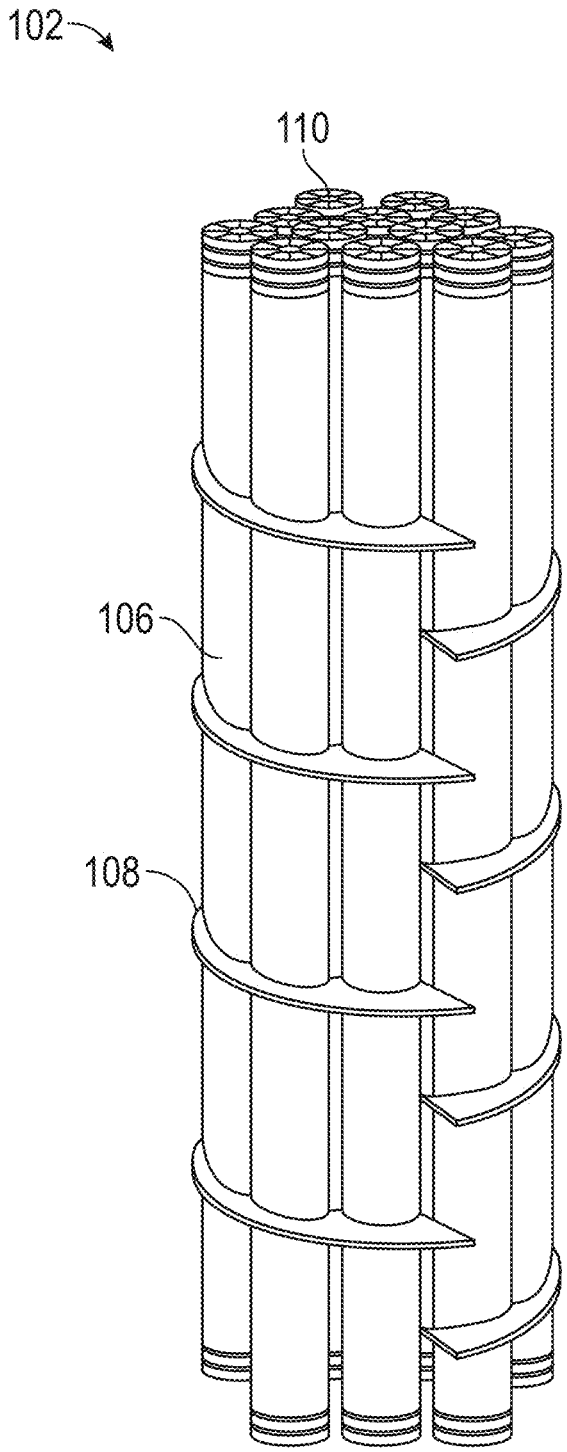
FIG. 11 shows one end of the inner group of tubes.

FIGS. 10 and 11 illustrate an exemplary tube-in-shell thermal compressor system 100 that is similar to the system 70 shown in FIGS. 7A-7D. The system 100 includes an internal unit 102 comprising several adsorber tubes 106 and baffles 108, and an outer shell 104 having an exterior wall 112 and inlet/outlet 114 for the heat exchange fluid. Each tube 106 includes an inner passageway 110 that is a porous structure that allows the working fluid to pass through the tubes and through the sorbent contained in each tube. Internal fins within the tubes 106 (see FIG. 13, for example) can enhance the heat transfer from the heat exchange fluid that flows between the exterior of the tubes 106 and the exterior wall 112.

Figure 12:
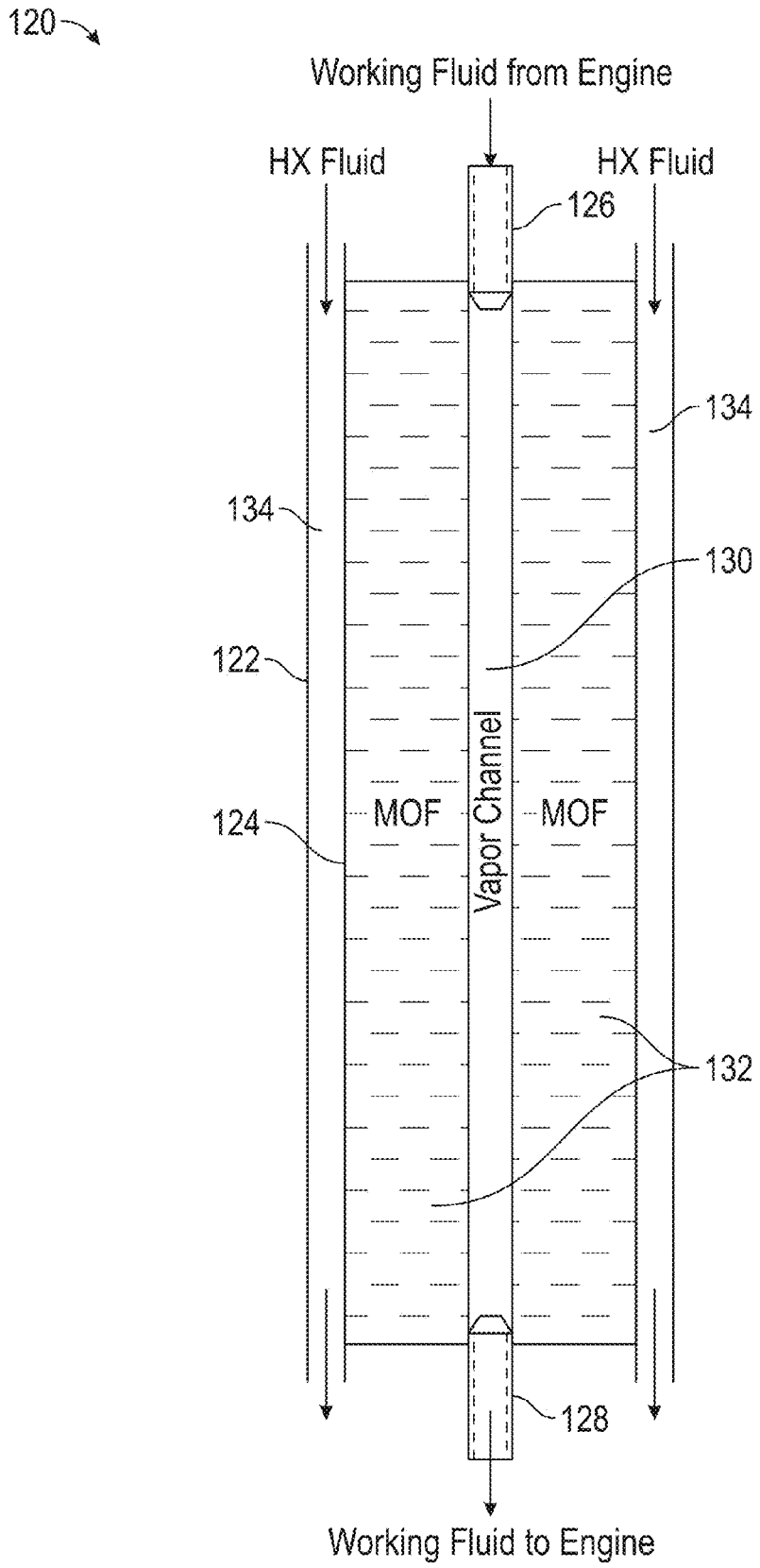
FIG. 12 illustrates a longitudinal cross-section of one of the tubes in use.

FIG. 12 is a simplified cross-sectional schematic of a single tube-in-shell adsorber 120 that helps illustrate the internal structure. The adsorber 120 includes an exterior cylindrical shell 122 and an internal tube 124 that contains sorbent 132. The tube 124 includes a central vapor channel 130 in the center of the sorbent 132. The vapor phase working fluid enters at inlet 126 and exits at outlet 128. While in the vapor channel 130, the working fluid adsorbs into the sorbent and later desorbs from the sorbent in a cyclical process. Heat exchange fluid is conducted through the annular conduit 134 between the shell 122 and the tube 124, such that heat can be transferred between the sorbent and the heat exchange fluid via the outer wall 124 of the tube.

Figure 13:
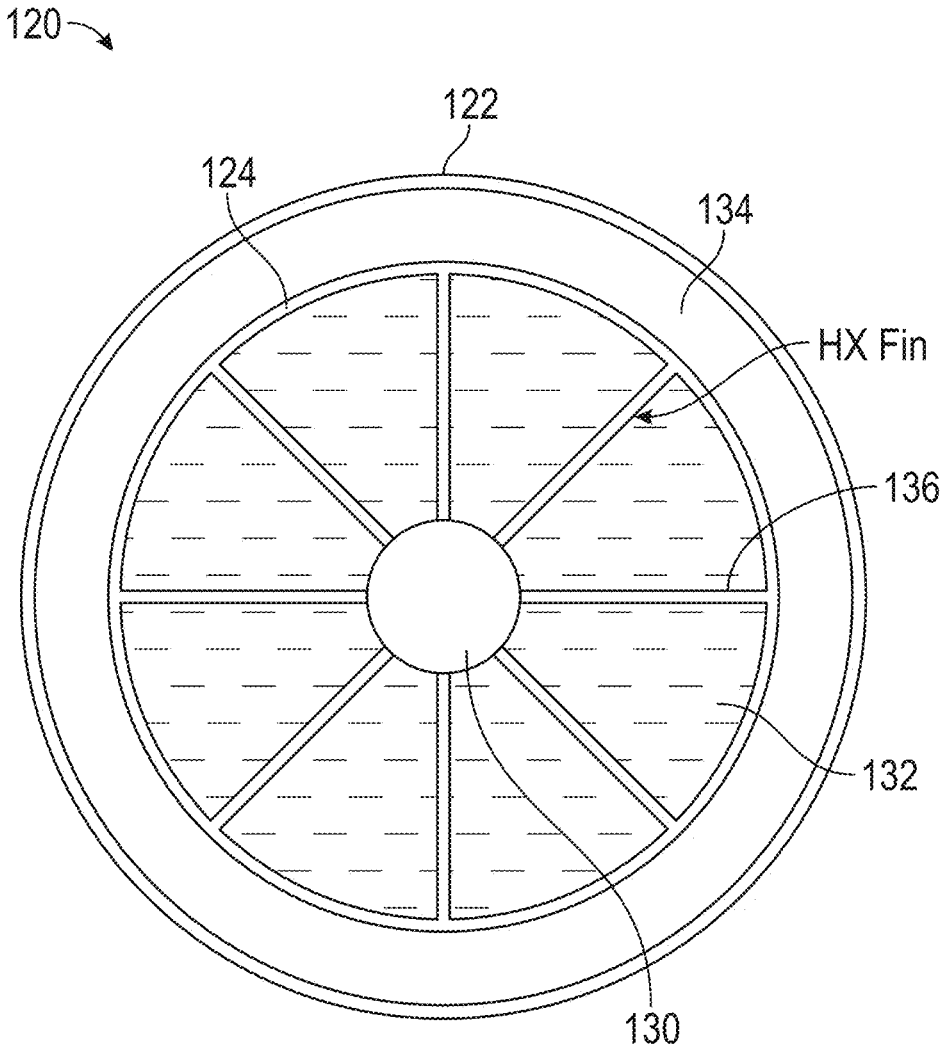
FIG. 13 illustrates a perpendicular cross-section of one of the tubes.

FIG. 13 shows a perpendicular cross-section of the single tube-in-shell adsorber 120 example shown in FIG. 12. FIG. 13 illustrates radially extending fins 136 that are attached to the outer wall 124 of the tube and help conduct heat between the sorbent and the outer wall. The fins 136 can also help contain and compartmentalize the sorbent 132 within the tube, and can help define the central vapor channel 130.

Figure 14:
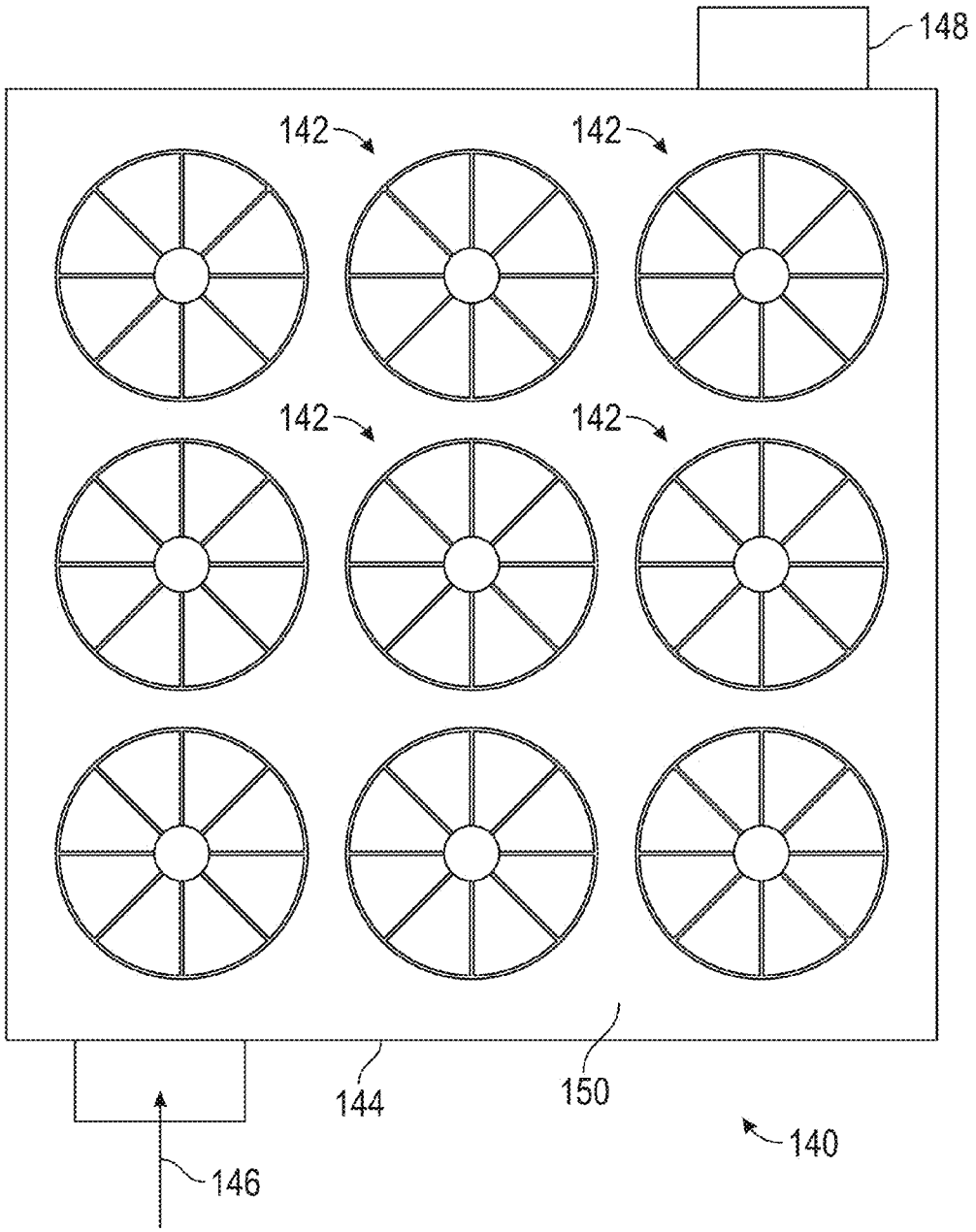
FIG. 14 illustrates a perpendicular cross-section of an exemplary tube-in-shell adsorption cooling system having a 3×3 array of tubes.

FIG. 14 illustrates an exemplary system 140 that includes a 3-by-3 array of sorbent containing tubes 142, similar to the tube 124 in FIGS. 12 and 13. The tubes 142 are contained within a rectangular outer shell 144 that has inlet 146 and outlet 148 for conducting heat exchange fluid around the outside of the tubes 142 in the space 150 within the shell 144.

Figure 15:
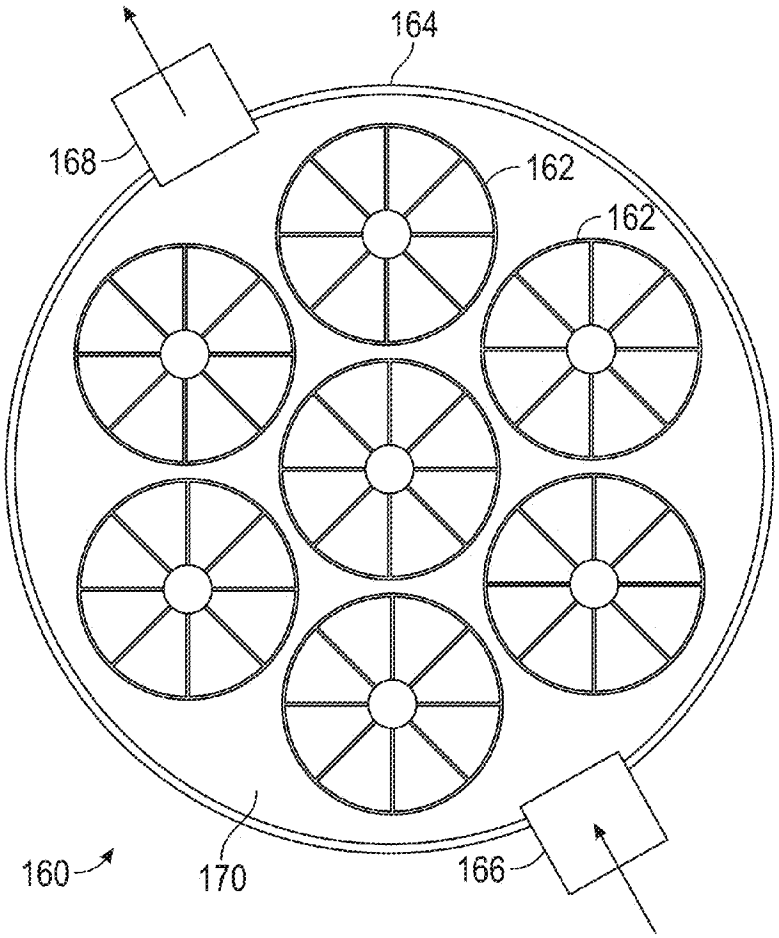
FIG. 15 illustrates a perpendicular cross-section of an exemplary tube-in-shell adsorption cooling system having a generally circular array of tubes.

FIG. 15 illustrates another exemplary system 160 that includes a cluster of seven sorbent containing tubes 162, similar to the tube 124 in FIGS. 12 and 13. The tubes 162 are contained within a circular outer shell 164 that has inlet 166 and outlet 168 for conducting heat exchange fluid around the outside of the tubes 162 in the space 170 within the shell 164.

Figure 16:
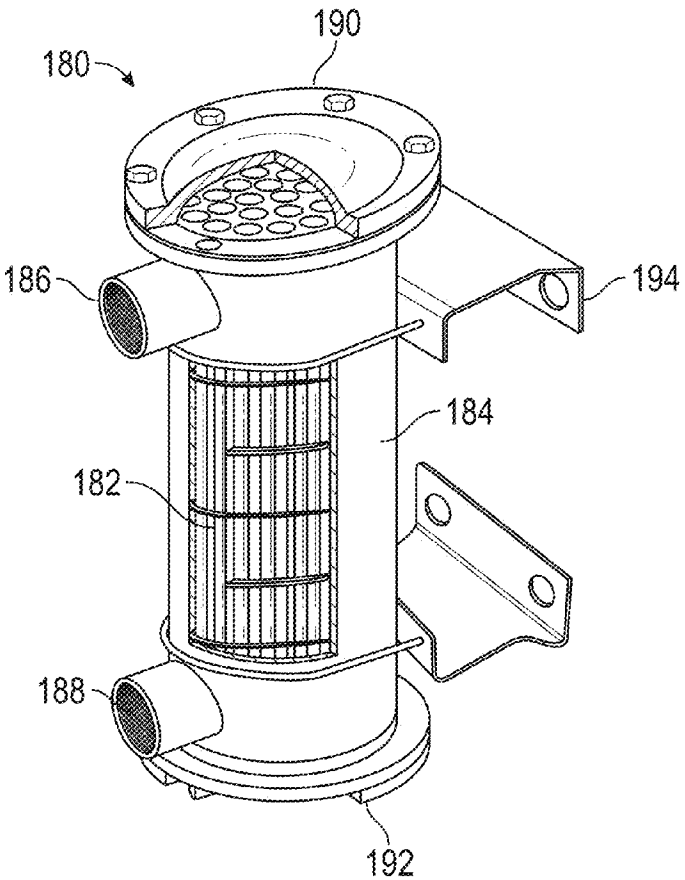
FIG. 16 is a perspective view of an exemplary tube-in-shell adsorption cooling system having a generally circular array of tubes, upper and lower headers, and mounting brackets.

FIG. 16 is a perspective view of another exemplary system 180 that includes a cluster of several sorbent containing tubes 182, similar to the tube 124 in FIGS. 12 and 13. The tubes 182 are contained within a cylindrical outer shell 184 that has an inlet and outlet 186 and 168 for conducting heat exchange fluid around the outside of the tubes 182 in the space within the shell 184. The system 180 includes headers 190, 192 at the ends of the tubes 182 that help conduct working fluid into and out of the central vapor channels of the tubes. The system 180 can optionally include brackets 194 for mounting the system.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically or chemically coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope of the following claims.

The invention claimed is:

1. A thermal compression power generation system, comprising:

a working fluid;

an engine driven by the working fluid;

a heat exchange fluid; and a thermal compression system comprising two or more independent adsorbers each containing a sorbent;

wherein the working fluid passes through the adsorbers and is adsorbed and desorbed by the sorbent;

wherein the heat exchange fluid passes through the thermal compression system and transfers energy to and from the working fluid while being desorbed and adsorbed by the sorbent;

wherein the working fluid remains in vapor phase while in the thermal compression system without condensing into liquid phase; and wherein the two or more independent adsorbers alternate between an adsorption phase and a desorption phase in a harmonic cycle, wherein during the desorption phase output pressure of the adsorbers falls to a minimum value while adsorber temperature rises to a maximum temperature, and during the adsorption phase the adsorbers begin at a lowest pressure in the cycle and pressure increases up to a maximum value.

2. The system of claim 1, wherein the two or more independent adsorbers operate out of phase with one another, such that at least one adsorber is adsorbing the working fluid while at least one adsorber is desorbing the working fluid.

3. The system of claim 2, wherein working fluid exiting the engine flows into one of the adsorbers in an adsorption phase, and working fluid entering the engine flows from one of the adsorbers in a desorption phase.

4. The system of claim 1, wherein the thermal compression system comprises four or more independent adsorbers.

5. The system of claim 4, wherein the four or more independent adsorbers alternate between a pre-cooling phase, an adsorption phase, a pre-heating phase, and a desorption phase, in harmonic cycles.

6. The system of claim 1, wherein the thermal compression system lacks a condenser.

7. The system of claim 1, wherein the thermal compression system lacks an evaporator.

8. The system of claim 1, wherein the thermal compression system lacks a working fluid pump.

9. The system of claim 1, wherein the thermal compression system comprises at least one adsorber having a tube-and-shell configuration.

10. The system of claim 1, wherein at least one of the adsorbers comprises a tubular body having a cylindrical wall and fins projecting radially inwardly from the cylindrical wall, with the sorbent positioned between the fins.

11. The system of claim 10, wherein a vapor channel is defined radially inside of the fins, and the working fluid passes through the vapor channel in contact with the sorbent.

12. The system of claim 10, wherein an outer shell is positioned around the cylindrical wall and the heat exchange fluid flows between the outer shell and the cylindrical wall.

13. The system of claim 1, where at least one of the adsorbers comprises a plurality of tubular adsorption beds containing the sorbent, and an outer wall positioned around the tubular adsorption beds, wherein the working fluid passing through the tubular adsorption beds and the heat exchange fluid passes between the tubular adsorption beds and the outer wall.

14. The system of claim 1, wherein the sorbent comprise a metal organic framework with a chemical affinity for the working fluid.

15. The system of claim 1, wherein the sorbent comprise a covalent organic framework with a chemical affinity for the working fluid.

16. The system of claim 1, wherein the sorbent comprise a hierarchical porous carbon with a chemical affinity for the working fluid.

17. The system of claim 1, wherein the sorbent comprise a zeolite or mesoporous silica framework with a chemical affinity for the working fluid.

18. The system of claim 1, wherein the sorbent comprises a composite combination of two or more of a metal organic framework, a covalent organic framework, a hierarchical porous carbon, and a zeolite or mesoporous silica framework, and wherein the sorbent is in the form a core-shell, a yolk-shell, or a mixed matrix with a chemical affinity for the working fluid.

19. The system of claim 1, wherein the adsorbers can achieve at least 98% of a theoretical liquid density of the working fluid in pores of the sorbent while the working fluid remains in vapor phase.

20. The system of claim 1, wherein the thermal compression system comprises a harmonic adsorption recuperative power (HARP) system.

21. The system of claim 1, wherein the thermal compression system achieves a compression ratio of at least 30:1.

22. A thermal compression power generation system, comprising:

a working fluid;

an expander driven by the working fluid;

a heat exchange fluid; and a thermal compression system comprising four or more independent adsorbers containing a sorbent;

wherein the working fluid passes through the expander and the four or more independent adsorbers, the working fluid adsorbed and desorbed by the sorbent while remaining in vapor phase;

wherein the heat exchange fluid originates from a heat source and passes through the four or more independent adsorbers; and wherein the four or more independent adsorbers are coupled in series and alternate between a pre-cooling phase, an adsorption phase, a pre-heating phase, and a desorption phase, in harmonic cycles.

* * * * *